US007818821B2

(12) United States Patent
Shirai et al.

(10) Patent No.: US 7,818,821 B2
(45) Date of Patent: Oct. 26, 2010

(54) PROTECTIVE CAP

(75) Inventors: Syoji Shirai, Tokyo (JP); Kazuhiko Tanizawa, Tokyo (JP)

(73) Assignee: Builmatel Co., Ltd., Tokyo (JP)

( * ) Notice: Subject to any disclaimer, the term of this patent is extended or adjusted under 35 U.S.C. 154(b) by 337 days.

(21) Appl. No.: 10/565,070

(22) PCT Filed: Jul. 14, 2004

(86) PCT No.: PCT/JP2004/010013

§ 371 (c)(1),
(2), (4) Date: Jan. 18, 2006

(87) PCT Pub. No.: WO2005/006901

PCT Pub. Date: Jan. 27, 2005

(65) Prior Publication Data

US 2006/0230506 A1 Oct. 19, 2006

(30) Foreign Application Priority Data

Jul. 18, 2003 (JP) ..... 2003-276380

(51) Int. Cl.
*A41B 1/06* (2006.01)

(52) U.S. Cl. ..... 2/410; 2/424

(58) Field of Classification Search ..... 2/171.4, 2/171.7, 410, 411, 412, 414, 415, 425
See application file for complete search history.

(56) References Cited

U.S. PATENT DOCUMENTS 3,039,108 A * 6/1962 Lohrenz ..... 2/412
3,457,563 A * 7/1969 Marchello ..... 2/414
4,141,085 A * 2/1979 Adams, Sr. ..... 2/410
4,369,782 A * 1/1983 McGee ..... 604/300
4,704,746 A * 11/1987 Nava ..... 2/424
5,090,054 A * 2/1992 Grilliot et al. ..... 2/5
5,771,497 A * 6/1998 Steele ..... 2/422
5,996,128 A * 12/1999 Yanagihara ..... 2/422
6,061,834 A * 5/2000 Liao ..... 2/171.3

FOREIGN PATENT DOCUMENTS

JP 59-113325 U 7/1984
JP 63-89924 U 6/1988
JP 63-175125 U 11/1988
JP 2-61931 U 5/1990
JP 10-195708 A 7/1998
JP 10-331021 A 12/1998
JP 2001-3220 A 1/2001

* cited by examiner

*Primary Examiner*—Shaun R Hurley
*Assistant Examiner*—Andrew W Sutton
(74) *Attorney, Agent, or Firm*—Manabu Kanesaka

(57) ABSTRACT

A safety hat has overwhelming light weight and marvelous air permeability as well as measures for water protection against rainy weather and the like. A front air hole 13 is provided in a visor portion 12 in front of a hat body 10 in a horizontal direction, the visor portion 12 is defined by a streamlined curvature so that an ambient air can be brought in smoothly, and an eave portion 15 of the hat body 10 covers a top end 12*a* of the visor portion 12 from the outside without contacting the same to form the front air hole 13. An air hole 17 is also provided at a back of a peak portion of the hat body 10. The front air hole 13 mainly functions as an inlet for the ambient air, and the rear air hole 17 functions as an outlet for the air introduced into and staying inside the hat body 10.

6 Claims, 3 Drawing Sheets

PROTECTIVE CAP

FIELD OF THE INVENTION

The present invention relates to a structure of a safety hat worn for protection of one's head during various works including construction and civil engineering.

BACKGROUND TECHNOLOGY

In sites and factories of various works, an worker avoids dangers from a flying object or a falling object as well as danger of falling by wearing a safety hat before such a danger happens, but the safety hat steams the worker's head with sweat by wearing the safety hat for a long time during summer time or hard work with a large quantity of labor. The steamed condition not only makes the works painful but also lowers the working efficiency.

As an attempt to provide the safety hat with air permeability, there has been known a safety hat formed by mesh or mesh porous materials so that absent areas are alternately positioned (see patent document 1). There have been other attempts to provide a working helmet or a riding helmet with air permeability by using air ventilation equipment (see patent documents 2 and 3). However, these safety hats do not have any protection from rain for outdoor use.

Although there has been disclosed a helmet having air permeability and protection from rain at the same time (see patent document 4), it is hard to achieve the original purpose of a helmet to protect a human head since there is possibility of a flying or falling object entering into the helmet and the helmet may not be strong enough due to fine pores provided in the side portions of the helmet body. The helmet does not have sufficient protection from rain because rain water may enter into the helmet when a worker bends himself to work.

Inventors of the present invention have suggested a safety hat including a double-structured hat body as a safety hat with air permeability and protection from rain (see patent document 5), but the double structure forces the safety hat to increase weight. Next, the inventors suggested a safety hat comprising a hat body having air conduit pores penetrating internal and external walls thereof, a drainage passage provided along the internal wall of the hat body to discharge water coming into the hat body through the air conduit pores, and air vent pores formed on the upper side of the drainage passage in the cross-section perpendicular to the water draining direction (see patent document 6). The safety hat was light in weight and excellent in terms of the rain protection, but there was still a room for improvement in terms of air permeability. The inventors then suggested a safety hat having a flow channel formed in the right and left side walls of the hat body, flowing ambient air in longitudinal directions and having a weathering structure, and the flow channel being connected to the internal of the hat body at the top portion of the hat body (see patent document 7), but the bottleneck of the safety hat is also how to reduce the weight.

[Patent document 1] Utility Model Publication No. SHO60-143736

[Patent document 2] Utility Model Publication No. SHO58-7832

[Patent document 3] Utility Model Publication No. HEI1-94430

[Patent document 4] Utility Model Publication No. SHO42-20108

[Patent document 5] International Publication No. WO95/28101

[Patent document 6] International Publication No. WO98/23176

[Patent document 7] Patent Publication No. 2000-303246

SUMMARY OF THE INVENTION

[Problems to be Solved by the Invention]

The present invention is intended for providing a safety hat with overwhelming light weight and marvelous air permeability as well as measures for water protection against rainy weather and the like.

[Means of Solving Problem]

The safety hat according to the present invention includes an air hole in each of a visor portion of a hat body and an opposing position to the visor portion, wherein the air hole in the visor portion is formed with the visor portion defined by a streamlined curvature and an eave portion of the hat body covering a top end of the visor portion from the outside without contacting the same.

The air hole disposed at the opposing position to the visor portion is preferably disposed with a shielding mechanism against a foreign object and a weathering structure.

The opposing position to the visor portion is preferably at a back of a peak portion of the hat body.

The air hole disposed at the opposing position to the visor portion is preferably formed with a back portion of the head defined by a streamlined curvature and the eave portion of the hat body covering an end of the back portion of the head from the outside without contacting the same.

The air hole in the visor portion is preferably disposed at the front side of the hat body in the horizontal direction.

It is preferred that an inner plate with an opening at the center is lined inside the peak portion of the hat body, and the air passage formed between the peak portion of the hat body and the inner plate is in communication with the air hole located at the opposing position to the visor portion, especially at a back of a peak portion of the hat body.

It is preferred that a front end of the inner plate is connected to a top end of the visor portion, and the air passage is in communication with the air hole in the visor portion.

A safety hat according to the present invention comprises an air hole disposed with a shielding mechanism against a foreign object and a weathering structure at each of a visor portion of a hat body and a back of a peak portion of the hat body, wherein a strip-shaped inner plate having an opening at the center thereof is lined inside of the peak portion of the hat body in connection with the air hole, and an air passage formed between a top portion of the hat body and the inner plate is in communication with the air hole.

It is preferred that the opening of the inner plate is located closer to an inside of the hat body rather than the periphery thereof, and a plurality of air vent pores opposing to the inner plate at the peak portion of the hat body and penetrating internal and external surfaces of the hat body are disposed at positions not overlapping the opening.

The inner plate preferably has a weir established at a periphery of the opening.

[Effects of the Invention]

The safety hat according to the present invention achieves overwhelming light weight and marvelous air permeability as well as measures for water protection against rainy weather and the like by introducing a large amount of ambient air into the hat body along the visor portion defined by a streamlined curvature.

In addition to the effects described above, the other safety hat with the inner plate lined inside the peak portion of the hat body facilitates the molding process thereof. Further, air permeability can be also dramatically improved by providing the air vent pores at the peak portion of the hat body.

EXPLANATIONS OF LETTERS OR NUMERALS

Figure 1:
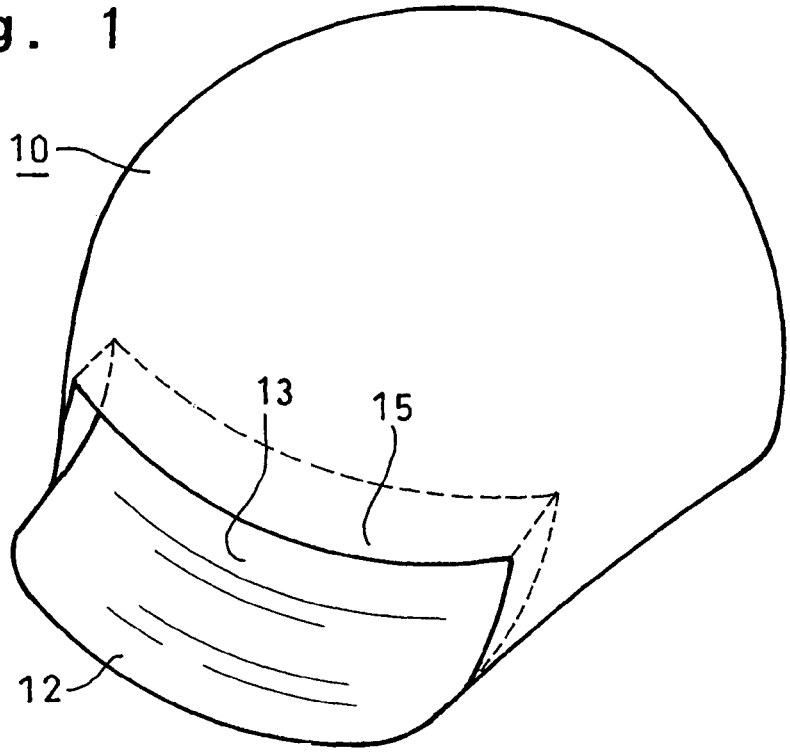
FIG. 1 is; a perspective view showing the hat body from the diagonally upper front.

10. Hat body
12. Visor portion
12*a*. Top end of the visor portion
13, 17. Air hole
15, 19. Eave portion
18. Back portion of the head
18*a*. Top end of the back portion of the head
20. Inner plate
21. Opening
22. Weir
25. Air passage
27. Air vent pore

DETAILED DESCRIPTION OF THE PREFERRED EMBODIMENT

The most preferred embodiment of the safety hat according to the present invention is described below with reference to the drawings.

FIG. 1 is a perspective view of the hat body 10 forming the main body of the safety hat as viewed from the upper front thereof, which is generally provided therein with a shock-absorbing liner for absorbing shock applied to the hat body 10, a wearing body (configured with a hammock, a head band, a loop and the like) for retaining the safety hat on the workers head and making it easy to wear the safety hat, and a chin strap for preventing the safety hat from dropping.

The hat body 10 may be made of synthetic resin such as polyester, polypropylene, polyethylene, polycarbonate, and ABS resin. When strength is required, the hat body may also be made of iron, steel, aluminum, aluminum base alloy, and other high-strength alloys, and fiber-reinforced plastic and ceramic may be also used depending on the application of the safety hat.

The visor portion 12 in front of the hat body 10 is provided with the front air hole 13 in the horizontal direction. The horizontal length of the front air hole 13 is preferably equivalent to or larger than the radius of the hat body 10. The number of the front air hole 13 is not necessarily one, but when there are more than one, the total length of the plurality of the front air hole 13 is preferably equivalent to or larger than the radius of the hat body 10. The upper limit of the horizontal length should be approximately the diameter of the hat body 10. The visor portion 12 is defined by the streamlined curvature so that the ambient air can be brought in smoothly, and the eave portion 15 of the hat body 10 covers the top end 12*a* of the visor portion 12 from the outside without contacting the same to form the front air hole 13.

Figure 2:
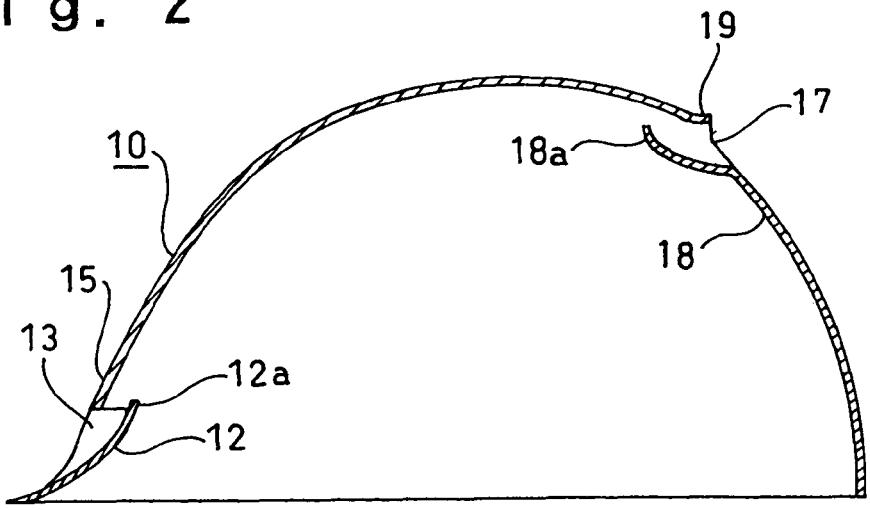
FIG. 2 is; a longitudinal side view showing the center portion of the hat body.

FIG. 2 is a longitudinal side view showing the center portion of the hat body 10, where the top end 12*a* of the visor portion 12 and the lower end of the front eave portion 15 play the role of a shielding mechanism against annealing wire and any other falling objects and flying objects that may enter the hat body 10 from outside since the top end 12*a* of the visor portion 12 and the lower end of the front eave portion 15 are overlapped in the horizontal direction. In order to have high air permeability, the distance between the top end 12*a* of the visor portion 12 and the lower end of the front eave portion 15 should preferably be long as much as possible on the condition that the shielding effect against foreign objects and weathering structure are satisfied.

The air hole 17 is also provided at the opposing position to the visor portion 12 of the hat body 10, which is located at the back of the peak portion of the hat body 10 in this embodiment. The rear air hole 17 is preferably located at a position opposing to the visor portion 12, especially at the back of the peak portion of the hat body 10, since the rear air hole 17 is required to function as an outlet for the air introduced into and staying inside the hat body 10 while the front air hole 13 mainly functions as an inlet for the ambient air.

In this embodiment, the rear air hole 17 is also formed by the back portion of the head 18 of the hat body 10 defined by the streamlined curvature and the rear eave portion 19 of the hat body 10 covering the top end 18a of the back of the head from the outside without contacting the same, like the front air hole 13, resulting to have the shielding mechanism against foreign objects and weathering structure. The safety hat according to the present invention is not limited to have this configuration as long as the rear air hole 17 is equipped with the shielding mechanism against foreign objects and weathering structure.

Figure 3:
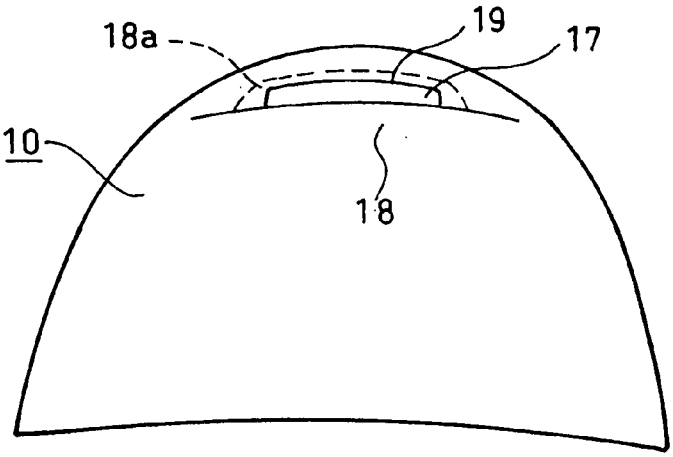
FIG. 3 is; a rear view of the hat body.

FIG. 3 is a rear view of the hat body 10 showing the rear air hole 17 as described above.

According to the present invention, since the front air hole 13 and the rear air hole 17 are open to the ambient air, the ambient air flows through the hat body 10. Especially, since a large amount of ambient air introduced into the hat body along the visor portion 12 defined by the streamlined curvature is directed to the rear air hole 17 along the internal wall of the hat body to flow without dispersion, wet air tending to stay in the hat body 10 consequently follows the flow of the ambient air to be discharged out of the hat body in an instant. The structure of the safety hat according to the present invention allows a large amount of ambient air flowing from the front air hole 13 to directly contact the forehead which is the most sensitive part to cold air on the head of the wearer of the safety hat, and therefore achieves an excellent cooling effect in somesthetic terms.

Figure 4:
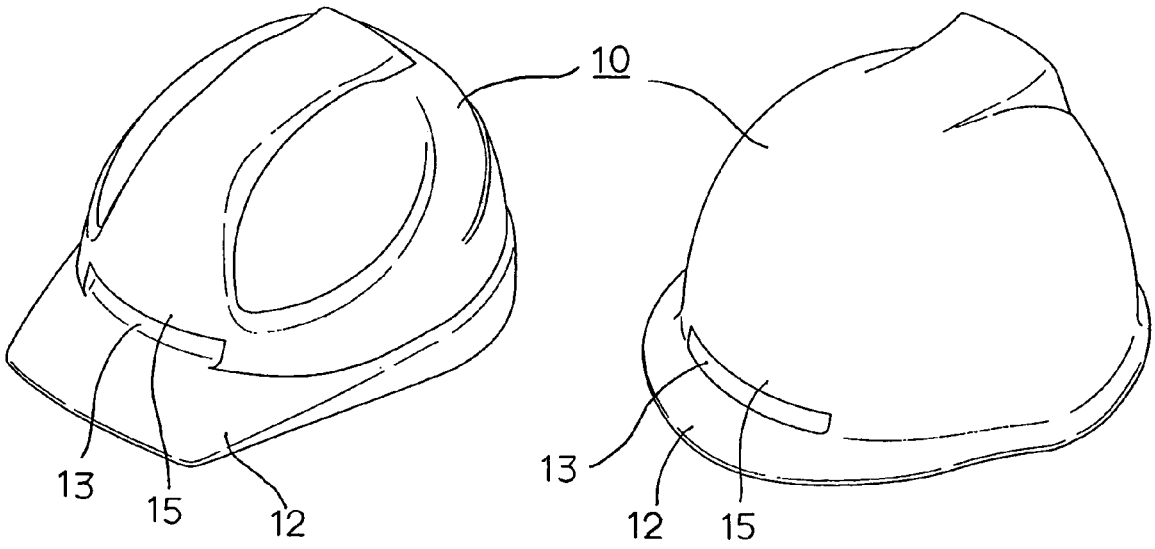
FIG. 4 is; a perspective view showing an example of the modified hat body.

FIG. 4 is a perspective view showing an example of the modified hat body. An embodiment of the safety hat having the front air hole 13 with the horizontal length slightly shorter than the radius of the hat body is shown on the left side, and another embodiment of the safety hat having the short visor portion 12 on the right side.

The hat body 10 in the present invention can be formed by mold tooling, and in the case it is difficult to form an entire body in one time molding, the body can be separated into a plurality of components for molding. For instance, if it is difficult to form the rear air hole 17 at a time, a hat body 10 may be as shown in FIG. 5.

Figure 5:
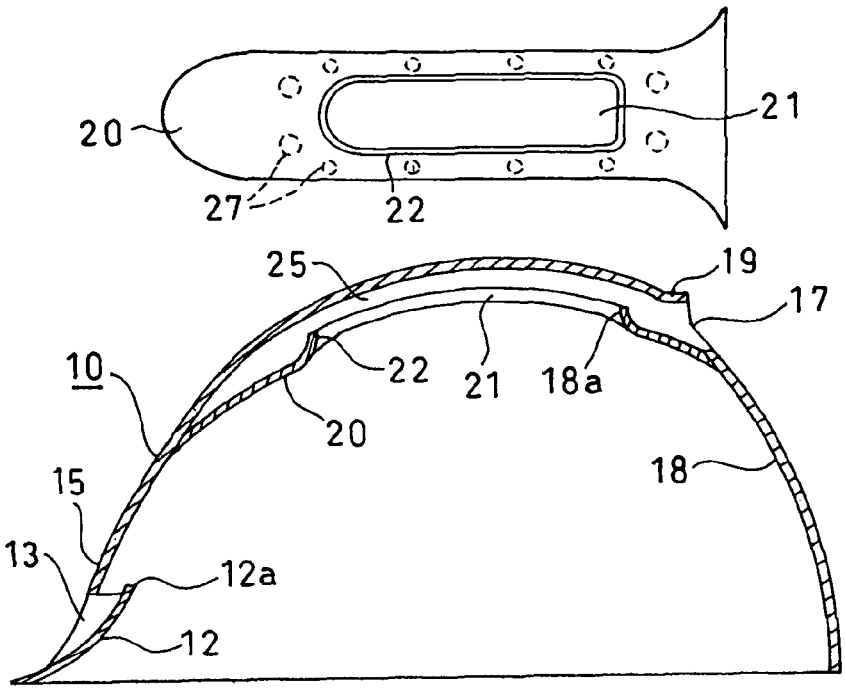
FIG. 5 indicates; a longitudinal side view showing another example of the modified hat body and a flat view of the inner plate.

According to the embodiment of the hat body 10 shown in the longitudinal side view in FIG. 5, the inner plate 20 is lined inside the peak portion of the hat body 10. The inner plate 20 is, as shown in the flat view above the hat body 10, a thin strip extending in the longitudinal direction of the hat body and provided with a large opening 21 at the center thereof. The air passage 25 formed between the peak portion of the hat body 10 and the inner plate 20 in this way and the internal of the hat body 10 are in communication with each other by the opening 21, and the air passage 25 is in communication with the rear air hole 17 at the same time.

While the inner plate 20 has an effect of reinforcing the peak portion of the hat body 10 requiring the strength most, the inner plate 20 is desired to be a small strip as light as possible.

As described above, it is important for the rear air hole 17 to have the shielding mechanism against the foreign object and a weathering structure. With this embodiment, the shielding mechanism against foreign objects is formed by establishing the weir 22 around the periphery of the opening 21 at the inner plate 20. It is necessary that the opening 21 is positioned closer to the internal surface of the hat body than the periphery thereof, and that the opening 21 is located at a higher position, for instance, by forming bumps on the surface of the inner plate 20.

With this embodiment, in order to improve air permeability, there are provided a plurality of air vent pores 27, 27 . . . penetrating the internal and external surfaces of the hat body 10 at the peak portion thereof. The air vent pores 27, 27 . . . are, as indicated by the dotted line in the flat view of the inner plate 20, provided at a position opposing to the inner plate 20 and not overlapping the opening 21. Both items are arranged so as not to overlap for the purpose of shielding from foreign objects and protection from water such as rain water, as described above.

The size of the air vent pores 27, 27 . . . is not specifically limited but may be any size capable of retaining sufficient strength of the hat body 10. The number of the air vent pores 27, 27 . . . is preferably between several and ten or more around the opening 21 opposing to the inner plate 20. The undermost air vent pores 27 also functions as a drainage passage. The shape of the air vent pores 27, 27 . . . is not limited to the circle as shown in the drawing.

The embodiment shown in FIG. 5 achieves marvelous air permeability by the functions of the front and rear air holes 13, 17 and the air vent pores 27, 27. . . . For the materials identical to the materials in the embodiment shown with reference to FIGS. 1 to 3, the same numerals are applied and the explanations are omitted.

Figure 6:
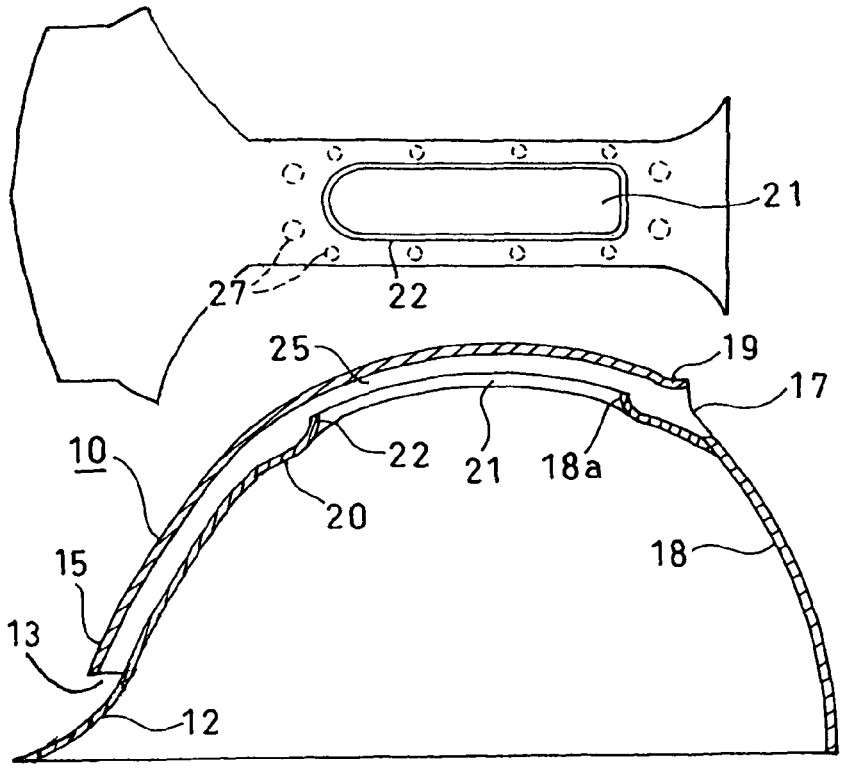
FIG. 6 indicates; a longitudinal side view showing another example of the modified hat body and a flat view of the inner plate.

The embodiment of the hat body 10 shown with reference to the longitudinal side view in FIG. 6 is an example of the modification from the embodiment shown in FIG. 5, where the visor portion 12 is configured as a part of the inner plate 20 by connecting the front tip of the strip-shaped inner plate 20 to the top end 12*a* of the visor portion. This embodiment allows the air passage 25 to be in direct communication with the air hole 13 in the visor portion 12 so that an even stronger flow of ambient air is formed along the internal wall of the hat body. With this embodiment, the visor portion 12 is not limited to be defined by the streamlined curvature but may be defined by a flat surface since the ambient air can be brought in smoothly through the air hole 13 in the visor portion 12.

With this embodiment, rain water entered from the air passage 25 is discharged from the air holes 13, 17. The number of the opening 21 is not limited to one but there may be a plurality of the opening 21. For the materials shown in FIG. 6 identical to the materials in the embodiment shown with reference to FIG. 5, the same numerals are applied and the explanations are omitted.

A penetration tolerance test (articles 6 and 7) and a shock absorption test (article 8) were performed on all of the described safety hats based on the standard specified by Minister of Labor (Announcement No. 39 by Ministry of Labor, Jun. 5$^{th}$, 1991), and the performance specified by each article was confirmed.

INDUSTRIAL APPLICABILITY

The safety hat according to the present invention may be used for various works such as construction, civil engineering, operation of heavy equipment, steering a working vehicle, a marine vessel and an aircraft, duties of security, police and fire-fighting inside and outside a building. The safety hat may also be widely used in a construction site of a building or a dam, a work site of a road or a tunnel, a dockyard, an ironworks, an iron factory, a quarry, and other various work sites and factories.

The invention claimed is:

1. A safety hat comprising:

a hat body having a top portion with a rear end, a front eave portion extending downwardly from the top portion and having a front lower edge extending substantially horizontally, and a back portion extending from the top portion and having an upper portion, said upper portion of the back portion being located inside the rear end of the top portion with a space therebetween to form a rear air hole therebetween, and a visor portion attached to the hat body and having a front end outside the hat body, a rear top edge located inside the hat body extending substantially horizontally and forming a horizontal edge of the visor portion without having a portion extending further inwardly from the rear top edge, and an upper surface smoothly curved upwardly from the front end toward the rear top edge, wherein said rear top edge is disposed laterally inwardly away from the front lower edge of the front eave portion and located vertically above the front lower edge of the front eave portion so that the visor portion continuously smoothly extends inwardly into the hat body with a space relative to the front lower edge of the front eave portion to form a front air hole between the front lower edge of the front eave portion and the visor portion, wherein said top portion and the front eave portion have a smooth inner surface to smoothly pass air entering from the front air hole to the rear air hole, and wherein the hat body has a single layer structure except for the upper portion of the back portion.

2. The safety hat according to claim 1, wherein said hat body has side portions extending from two sides of the front lower edge of the front eave portion to define the front air hole between the front lower edge of the front eave portion and the upper surface of the visor portion.

3. The safety hat according to claim 2, wherein one air hole is defined between the front lower edge of the front eave portion and the upper surface of the visor portion and between the side portions.

4. The safety hat according to claim 1, wherein said front air hole has a width same as that of the visor portion.

5. The safety hat according to claim 1, wherein said front air hole has a width less than that of the visor portion.

6. The safety hat according to claim 1, wherein the hat body and the visor portion are formed integrally.

* * * * *